US008127651B2

(12) United States Patent
Henkemeyer et al.

(10) Patent No.: US 8,127,651 B2
(45) Date of Patent: Mar. 6, 2012

(54) MULTI-PATTERN MATERIAL PUNCH

(75) Inventors: Sherri L. Henkemeyer, Clear Lake, MN (US); Carmen Lira-Nunez, Appleton, WI (US)

(73) Assignee: The Antioch Company LLC, St. Cloud, MN (US)

( * ) Notice: Subject to any disclaimer, the term of this patent is extended or adjusted under 35 U.S.C. 154(b) by 393 days.

(21) Appl. No.: 12/445,117

(22) PCT Filed: Oct. 12, 2007

(86) PCT No.: PCT/US2007/081309

§ 371 (c)(1),
(2), (4) Date: May 11, 2009

(87) PCT Pub. No.: WO2008/046076

PCT Pub. Date: Apr. 17, 2008

(65) Prior Publication Data

US 2010/0294102 A1 Nov. 25, 2010

Related U.S. Application Data

(60) Provisional application No. 60/851,600, filed on Oct. 13, 2006.

(51) Int. Cl.
*B26F 1/04* (2006.01)

(52) U.S. Cl. ..... 83/691; 83/686; 83/549

(58) Field of Classification Search ..... 83/686, 83/549, 468.5, 687, 691, 620, 468.3, 468.6, 83/468.7; 30/358, 360, 367, 315, 316, 277, 30/293; 234/44, 131

See application file for complete search history.

(56) References Cited

U.S. PATENT DOCUMENTS

| | | | | |
|---|---|---|---|---|
| 5,967,786 | A | 10/1999 | Wang | |
| 6,000,139 | A | 12/1999 | Chan | |
| 6,076,447 | A * | 6/2000 | Damask | 83/618 |
| 6,209,434 | B1 | 4/2001 | Kim et al. | |
| 6,672,191 | B2 * | 1/2004 | Lin | 83/549 |
| 6,752,058 | B2 | 6/2004 | Oh | |
| 6,918,332 | B1 * | 7/2005 | Andersen | 83/589 |
| 7,201,101 | B2 * | 4/2007 | Oh | 101/3.1 |

OTHER PUBLICATIONS

European Patent Office, "Communication about intention to grant a European patent," issued Jun. 10, 2010 in corresponding European Patent Application No. EP07854016 (1 page).

European Patent Office, selection from "Druckexemplar" showing approved claims referenced by "Communication about intention to grant a European patent," issued Jun. 10, 2010 in corresponding European Patent Application No. EP07854016 (2 pages).

Letter to European Patent Office dated Apr. 29, 2010 in corresponding European Patent Application No. EP07854016 (3 pages).

"Amended claims with annotations" filed with letter to European Patent Office dated Apr. 29, 2010 in corresponding European Patent Application No. EP07854016 (2 pages).

* cited by examiner

*Primary Examiner* — Ghassem Alie

(74) *Attorney, Agent, or Firm* — Dicke, Billig & Czaja PLLC

(57) ABSTRACT

A system for punching one or more patterns selected from a plurality of related patterns into a workpiece (typically paper or similar materials). The system comprises a punch element having a plurality of cutting surfaces arranged at discrete heights relative to each other, and a means for selecting a discrete distance that the punch element travels through the workpiece.

13 Claims, 9 Drawing Sheets

STEP 1 POSITION

STEP 2 POSITION

STEP 3 POSITION

MULTI-PATTERN MATERIAL PUNCH

RELATED APPLICATION

This application claims the benefit of U.S. Provisional Patent Application No. 60/851,600 filed 13 Oct. 2006.

TECHNICAL FIELD

This application concerns punches for paper and similar materials, especially those commonly used in scrapbooking and related crafts.

BACKGROUND

One particularly popular aspect of scrapbooking is to punch patterns of cutouts in papers and other similar materials.

SUMMARY

A unit or system for producing cutouts in material by punching a selected design or group of patterns from a set of related patterns that form a coordinated design of cutouts in the material. The system comprises at least one spring-loaded punch and die combination, in which the punch travels through the die by a controlled depth. The depths to which the punch may travel through the die are varied by selecting one of a plurality of stops that correspond to the set of possible portions of the coordinated pattern.

BRIEF DESCRIPTION OF THE FIGURES

The accompanying figures show a particular preferred embodiment as an example, but such illustration is not intended to limit the scope of the claims. In particular, the proportions and/or dimensions that may be shown in, or suggested by, the figures are preferred but not required except as specifically set forth in the claims.

DETAILED DESCRIPTION

Figure 1:
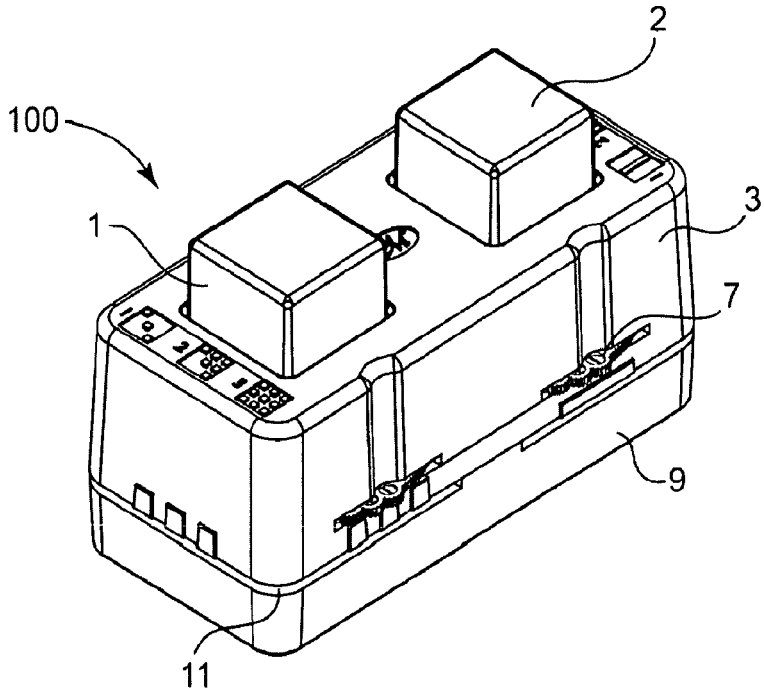
FIG. 1 is a perspective view of the preferred embodiment.
Figure 2:
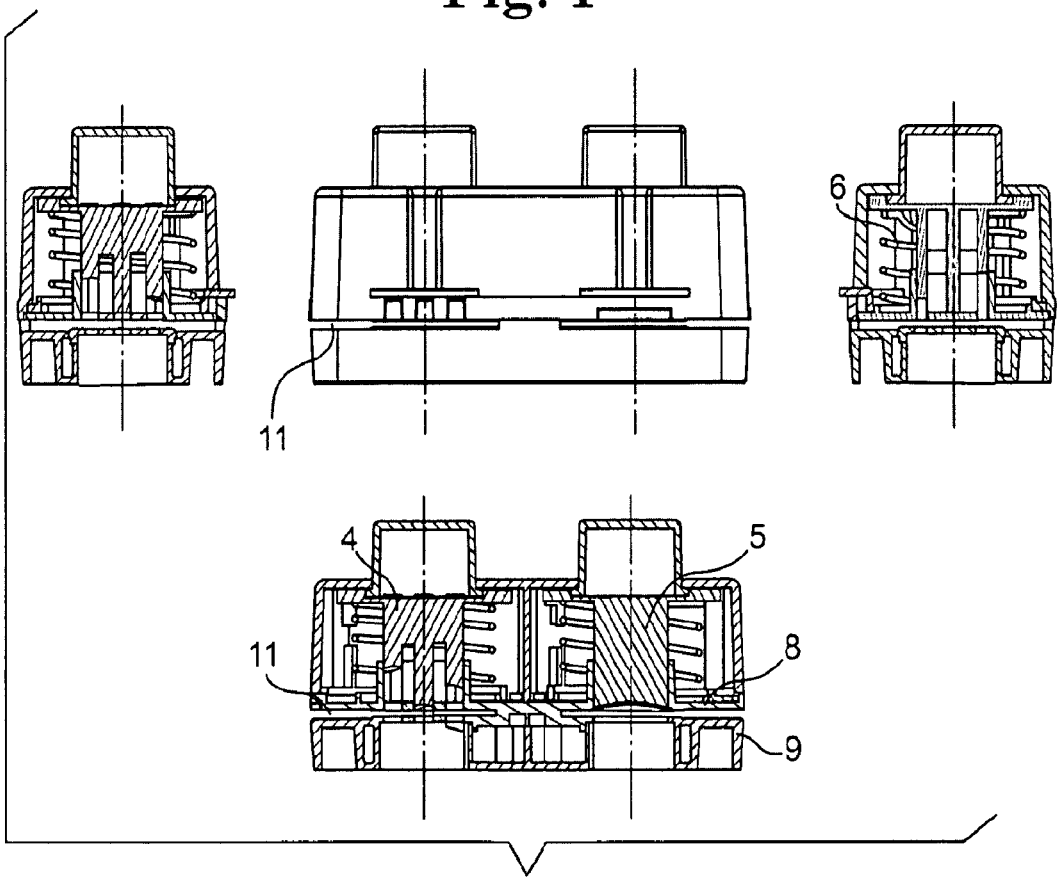
FIG. 2 is a side view of the preferred embodiment of FIG. 1, surrounded by a set of three cross-sectional views of the same, such views being designated A-A (FIG. 1), B-B (FIG. 2), and C-C (FIG. 2).
Figure 3:
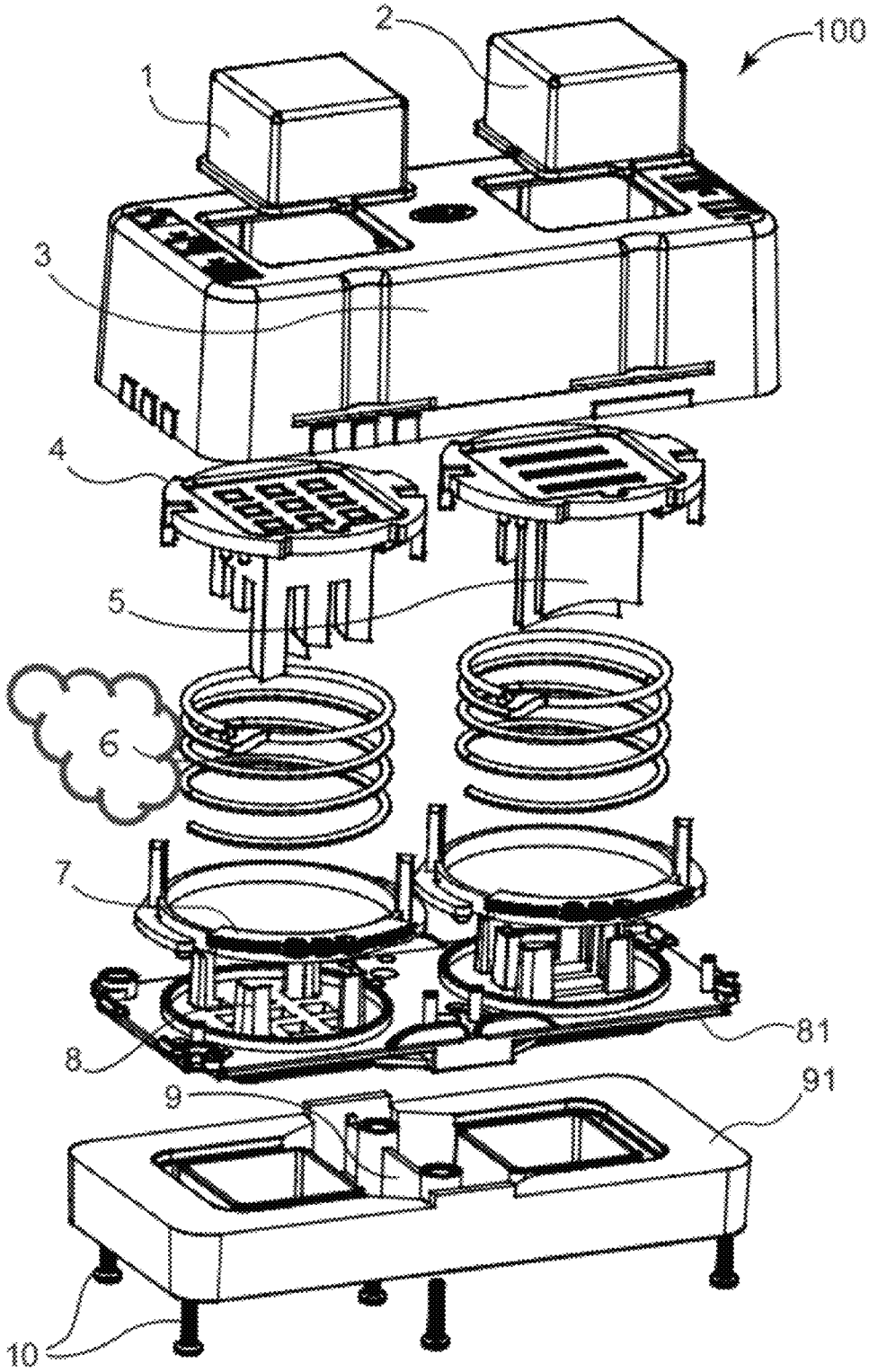
FIG. 3 is an exploded perspective view of the preferred embodiment.

In general terms, the claims define a punch for decorative cutouts in paper or similar materials, of the type disclosed in U.S. Pat. No. 6,428,248 (Lee), the entire contents of which is incorporated by reference for purposes of establishing vocabulary and environment that serve as background information to the field of the invention.

Overview

Referring to FIGS. 1-5, the preferred embodiment comprises two independently operating punch assemblies, combined into a single unit 100 solely for convenience. The scope of this application includes embodiments having any number of punch assemblies otherwise meeting the following description.

Each of two buttons 1, 2 is supported by and within common housing or cover 3, independently driving its respective punch 4, 5 against one of two springs 6 (typical of two). The depth to which either each punch may travel though its respective side of common lower die 8 is determined the rotational position of its respective selector 7 (typical of two). All these components are supported by a common base 9 which is attached to common housing 3, such as the centermost pair of preferred screws 10 (typical of six, only five of which appear in the perspective view). Other conventional means for attaching the common housing 3 to the common base 9 are acceptable.

The combination of housing 3 and base 9 provides a slot 11 for each punch assembly, through which the workpiece (paper or similar material; not shown) may be inserted prior to punching. In the preferred embodiment illustrated, each slot 11 extends around three sides of each end of the unit 100, which provides a large degree of flexibility in terms of arranging the position of the cutouts onto the workpiece.

Figure 4:
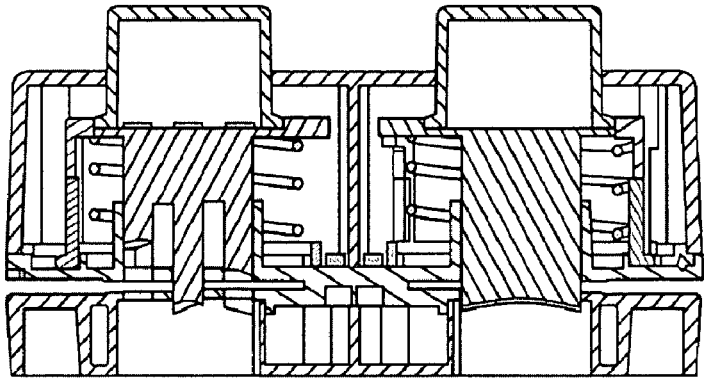
FIG. 4 is a set of three cross-sectional side views of the preferred embodiment in operation, corresponding respectively to each of three positions of the selector components.
Figure 4:
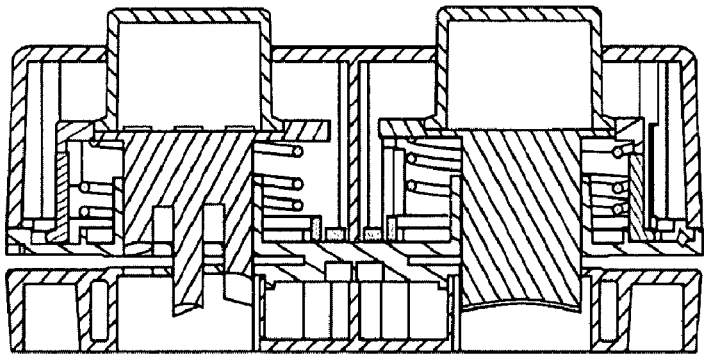
Figure 4:
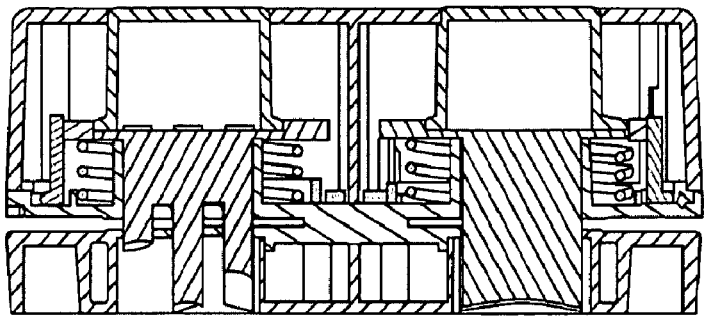

As illustrated specifically in FIG. 4, a set of three side cross-sectional views illustrating each of the three positions or steps at which the punch 4, 5 may be stopped by the selector mechanism 7, each side of unit 100 is selectively capable of producing a set of three different patterns in the workpiece. The number of steps (and thus the number of patterns) is also variable, provided at least a plurality of steps is provided.

Figure 5:
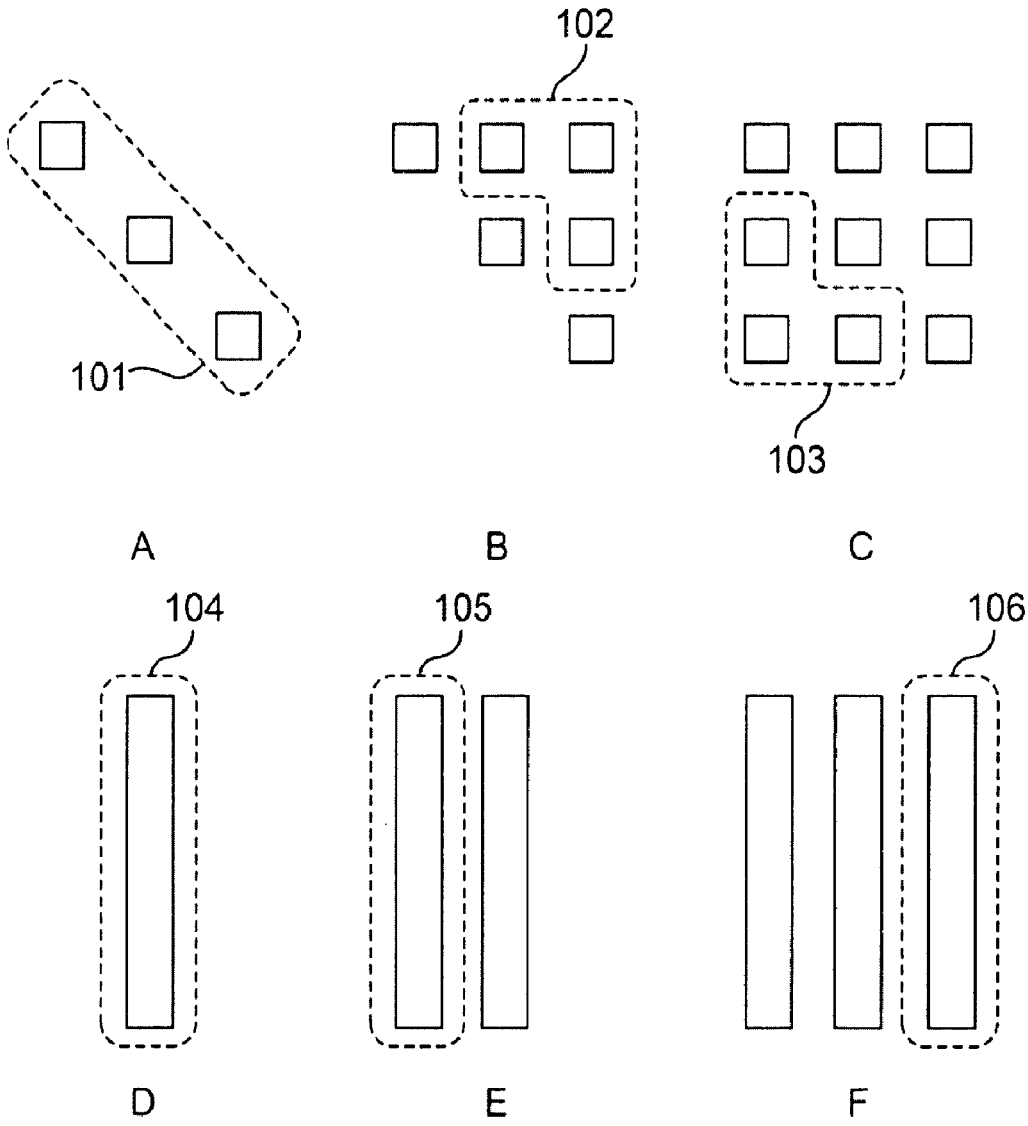
FIG. 5 illustrates two preferred sets of cutout patterns produced by the preferred embodiment.
Figure 11:
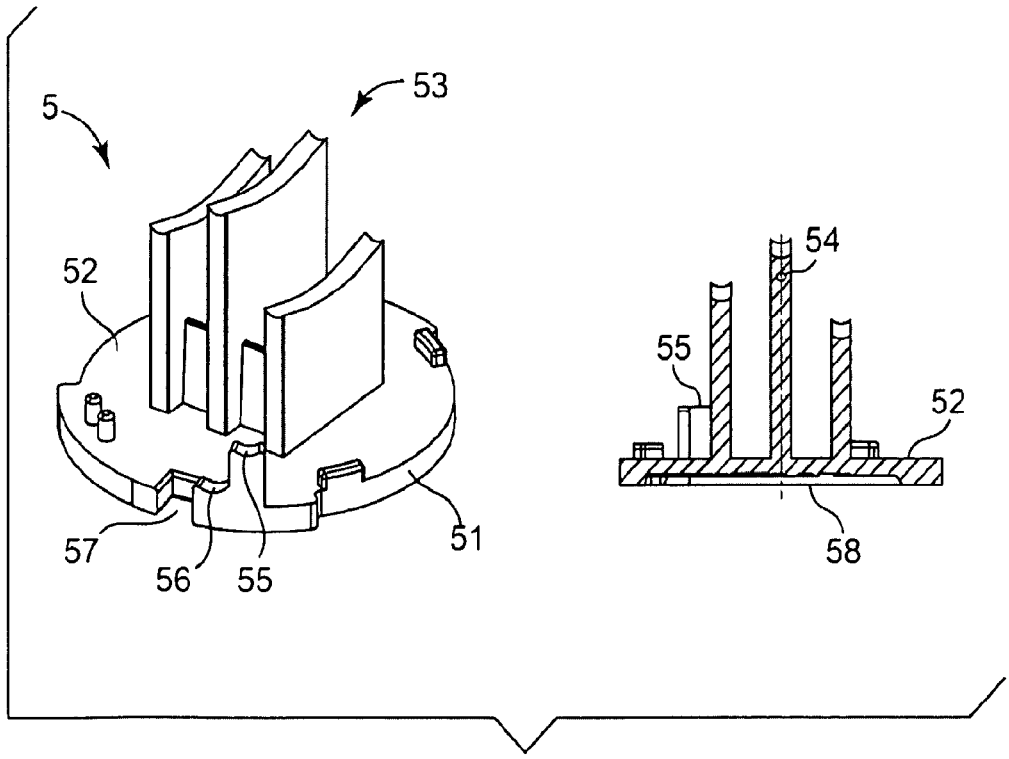
FIG. 11 is a set of perspective and side cross-sectional views of another of the punch components of the preferred embodiment.

One such set of patterns comprising square or diamond cutouts is illustrated in FIG. 5 and labeled A, B, and C; this set is produced by the punch assembly corresponding to punch 4 (see also FIG. 11). Another such set of patterns comprising rectangular cutouts is illustrated in FIG. 5 and labeled D, E, and F; this set is produced by the punch assembly corresponding to punch 5 (see also FIG. 11). The specific shapes of the cutouts, as well as the patterns in which they are arranged, are only examples. That is, either the cutouts, or the patterns of cutouts, may be geometrical shapes (including circles, semicircles, other portions of circles, ovals, triangles, regular or irregular polygons, etc.); celestial bodies (star, moon, sun, comets); hearts, stars (of any number of points), yin-yang, and other symbols; living creatures such as insects, animals, mammals; religious symbols (e.g., cross or crucifix, Star of David); musical notation; "barrel" or "pincushion" or hourglass shapes (i.e., those having generally convex or concave sides); or flowers (including portions such as petals, leaves, and stems).

Referring also to FIG. 4, because the individual cutting surfaces of each punch 4, 5 are similarly staggered at different heights, each of the distances that the punch travels corresponds to a different cutout pattern being created by the punch at different positions of travel. Such positions may be referred to as "Step 1 Position," "Step 2 Position," and "Step 3 Position."

Thus, referring again to the preferred cutout shapes and patterns of cutouts illustrated in FIG. 5, pattern 101 or 104 as shown in A or D, respectively, corresponds to Step 1 Position, in which only the cutting surfaces that extend the greatest amount overall extend far enough into the die to punch the material. In the preferred embodiment, the distance of travel is 5.5 mm out of a total possible distance of 16.5 mm.

The intermediate position, or next distance into the die, is Step 2 Position, which additionally produces pattern 102 or 105, with the total cutout result being as shown in B or E, respectively. In the preferred embodiment, the distance of travel is 11.0 mm out of a total possible distance of 16.5 mm.

The third distance, in which all cutting surfaces extend far enough into the die to punch the material, additionally produces pattern 103 or 106, with the total cutout result being shown in C or F, respectively. In the preferred embodiment, the distance of travel is 16.5 mm out of a total possible distance of 16.5 mm.

The use of a rotating selector 7 and its features as described above is only the preferred approach for limiting the travel of punch 4, 5 though lower die 8. Other means for selectively determining the extent of travel of punch 4, 5 relative to lower die 8 may be used, including those that limit the travel of punch 4, 5 and those that move the position of die 8 (although the former is preferred). Examples include buttons, levers, tabs, and the like.

Component Details

Many of the specific details of the components described below are dictated to large degree by the design and engineering of the preferred embodiment illustrated. However, such details are not necessarily required in the broadest embodiment enabled by this application. Similarly, alternative constructions that achieve the same functions as the components and features described below are within the scope of the broadest embodiment disclosure unless specifically excluded by the claims.

Figure 6:
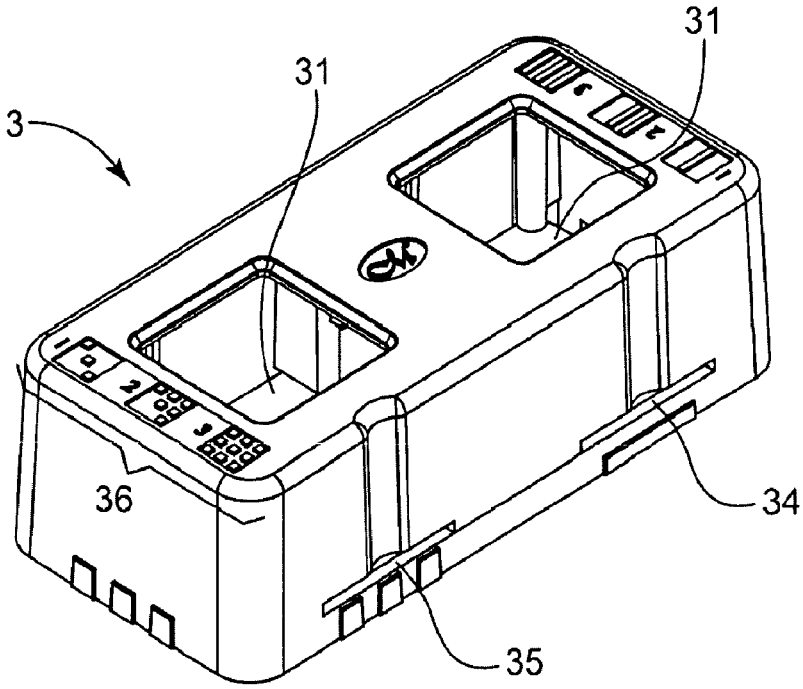
FIG. 6 is a perspective view of the top side of the cover component of the preferred embodiment.
Figure 7:
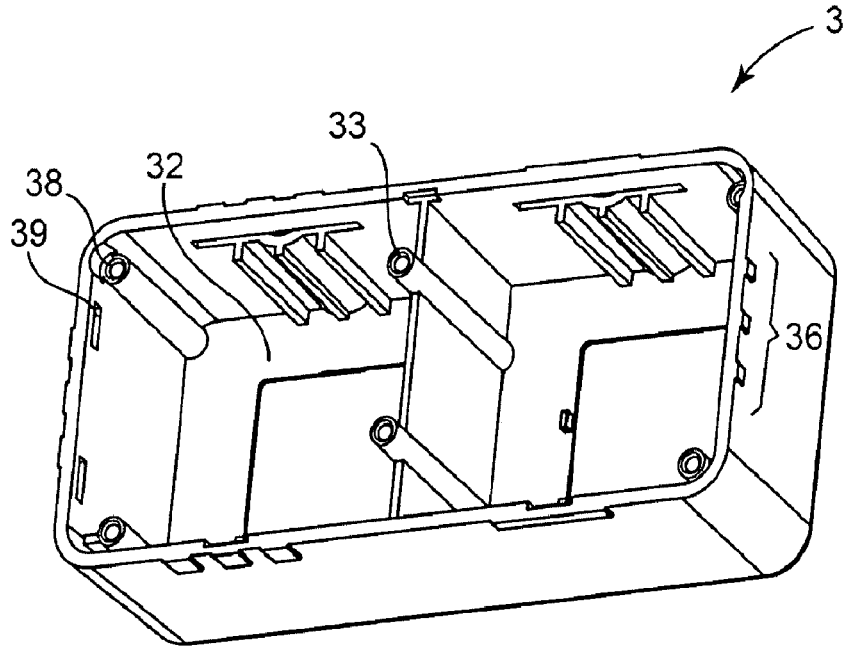
FIG. 7 is a perspective view of the bottom side of the cover component of the preferred embodiment.
Figure 9:
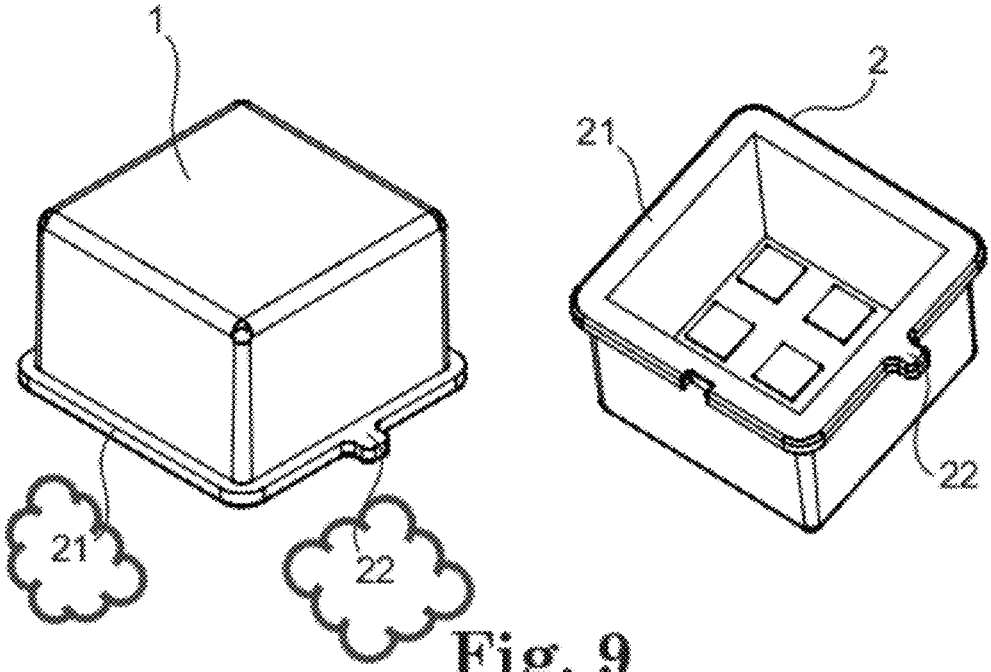
FIG. 9 is a set of perspective views of the top and bottom sides of one of the button components of the preferred embodiment.

FIGS. 6 and 7 illustrate the cover 3. It defines two central openings 31 through which buttons 1, 2 extend outwardly. Referring briefly to FIG. 9, each button 1, 2 comprises a feature that restricts it from traveling fully outside cover 3, more specifically the perimeter ledges 21 that engage the interior surface 32 of cover 3. Cover 3 further comprises a central pair of holes 33 which accept two of the screws 10 to hold unit 100 together when assembled. The other holes 38 adjacent the four corners of cover 3 accept four screws 10 that hold together a sub-assembly of all components except base 9, as described further below.

Side openings 34 are provided to enable selector 7 to extend outwardly from the interior of unit 100. An optional recess 35 increases the amount of selector 7 visible from the exterior of unit 100. Various other indicia 36 may be molded (preferred) or otherwise provided with cover 3 (e.g., adhesive stickers) to identify the various configurations of punched patterns that may be created with each position of each punch. As best seen in FIG. 7, a series of indentations 39 at various locations around the inner perimeter of cover 3 may be used to accommodate complimentary alignment tabs 90 of die 8 (see FIGS. 11 and 12). Other features may be molded or otherwise provided to improve the structural stability of cover 3, in accordance with known principles. Preferred materials for the cover include cast metals and polymers such as ABS (most preferred).

Figure 8:
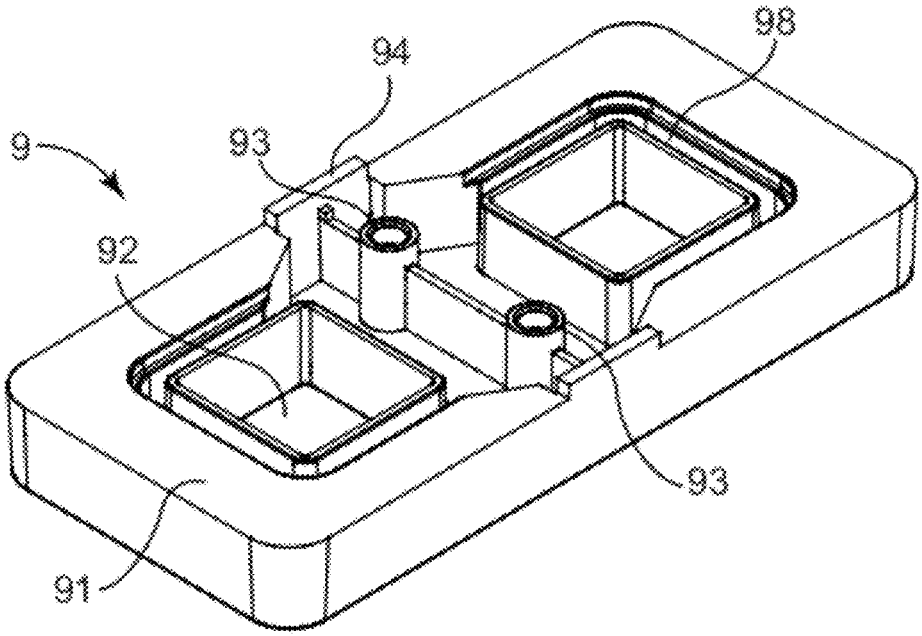
FIG. 8 is a top perspective view of the base component of the preferred embodiment.

FIG. 8 illustrates the base 9. Base 9 is attached to cover 3 by two of the screws 10 (see FIG. 3) that pass through holes 93 and onward to the center pair of holes 33 in cover 3 (see FIG. 7). In addition to presenting an upper face 91 that defines the lower portion of the outermost portion of slot 11 (see FIG. 3), base 9 defines two passages 92 into which the punches 4, 5 pass as they travel downward. Each of a pair of risers 94 provides an elevated location for contacting the corresponding central plateau 85 of the lower side of die 8 (see FIG. 12), which helps define the innermost portion of slot 11. The lower side of die 8 has features 88 so that die 8 securely seats into corresponding features 98 of base 9 and thus additional precision in this portion of the assembly of unit 100 is provided. The innermost portion of slot 11 is narrower in height than the outermost portion so that additional precision in punching through the workpiece may be achieved by reducing the amount of play the workpiece is permitted to have in the immediately vicinity of the punching elements. Preferred materials for the base include cast metals and polymers such as ABS (most preferred).

FIG. 9 illustrates each of the two buttons 1, 2. Button 1 is shown from above and button 2 from below (within unit 100) in normal use. In the preferred embodiment each button is square in cross section but this is not required. Button 2 illustrates that each button is preferably molded on the interior face of its top to correspond to the cutout shape produced by its respective punch; in use, such indicia are visible from above (although this is not specifically illustrated for button 1) due to the use of a transparent or translucent material to form each button. Each button defines the perimeter ledge 21 described before, and also a tab 22 that is useful in orienting the button into proper position. Preferred materials for the buttons include lightweight molded polymers, particularly transparent or translucent materials that allow the user to determine visually which punch lies beneath the button as just described. These include polymers such as ABS (most preferred).

Figure 10:
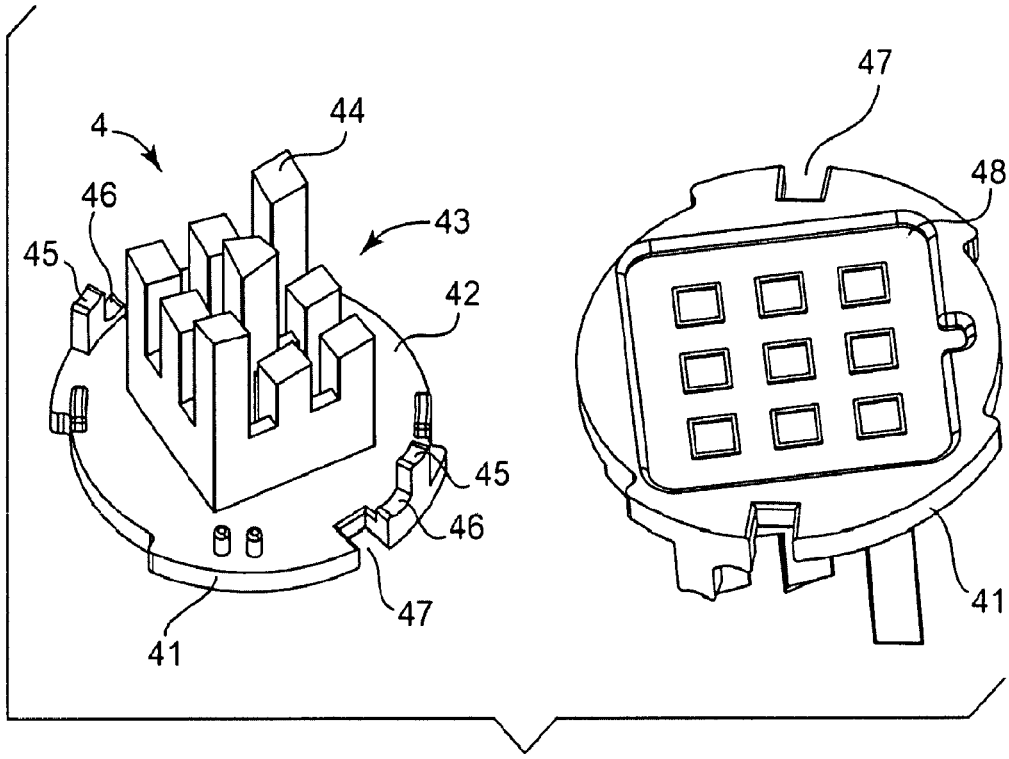
FIG. 10 is a set of perspective views of the upper and lower sides of one of the punch components of the preferred embodiment.

FIGS. 10 and 11 illustrate the two punch components of the preferred embodiment, with FIG. 10 illustrating the punch component 4 (which forms a series of series of groups of square or diamond cutouts) and FIG. 11 illustrating the other punch component 5 (which forms a series of parallel thin rectangular cutouts). Except for the pattern created, the operation of each punch component is substantially the same.

Each punch component 4, 5 comprises a base 41, 51 having a flat face 42, 52 and a collection of cutting elements 43, 53 rising perpendicularly from its respective base 41, 51. Each collection of cutting elements 43, 53 comprises a set of individual cutting punches 44, 54 that lie at differing distances from flat faces 42, 52, such differing distances creating the variation in punched pattern described above when the punch 4, 5 is moved by one of the selected distances. The preferred embodiment illustrates the possible variety of angles at which the sharpened cutting edges of each of the collection of cutting punches 44, 54 are oriented.

As best illustrated in FIG. 10, punch component 4 further comprises a pair of sets of elevated steps 45, 46. A third "step" is provided by the flat face 42 of base 41. Thus, there are three steps in the preferred embodiment illustrated, each located at a different distance from the base of the punch, and thus each corresponds to one of three different distances which the punch may travel into the lower die before contacting the elevated stops 71, 72 of the selector 7 as described further below. This combination of steps and stops allows different punch elements to extend into the workpiece by different amounts, depending on the position of the selector 7. As described earlier (see also FIG. 4), when the selector 7 permits the punch to extend into the workpiece by the least amount, the tallest punch element (or tallest set of elements) punches into the workpiece. When the selector is in the intermediate position, the tallest and intermediate elements (or set of elements) punches into the workpiece. When the selector permits the punch to extend into the workpiece by the greatest amount, all three elements (or all three sets of elements) punch into the workpiece.

The height and location of each such step are coordinated with the height and location of stops 71, 72 of selector 7 as described below. As mentioned before, the third "step" is flat face 42, but this is only a preference. However, it allows for the selector 7 to create the third position by being rotated until stops 71, 72 align with opening 47 adjacent step 47, which permits punch 4 to travel until flat face 42 contacts the elevated housing portion 87 of die 8 (see FIG. 12) that (in the preferred embodiment) entirely surrounds the set of holes 82 (described further below). This provides a "hard stop" to the entire operation of unit 100.

Note also that the steps are arranged in a sequence of continuously increasing height above flat face 4, which again is only a preference. However, because of the alternating heights of the collections of cutting elements in each punch 4, 5 (described below), the entire collection of punched holes illustrated in FIG. 5 is created in the sequence of 101, 104, followed by 102, 105 on one side, followed by 104, 106 on the other side. Such sequences may be arranged as desired in other embodiments of the invention.

Figure 12:
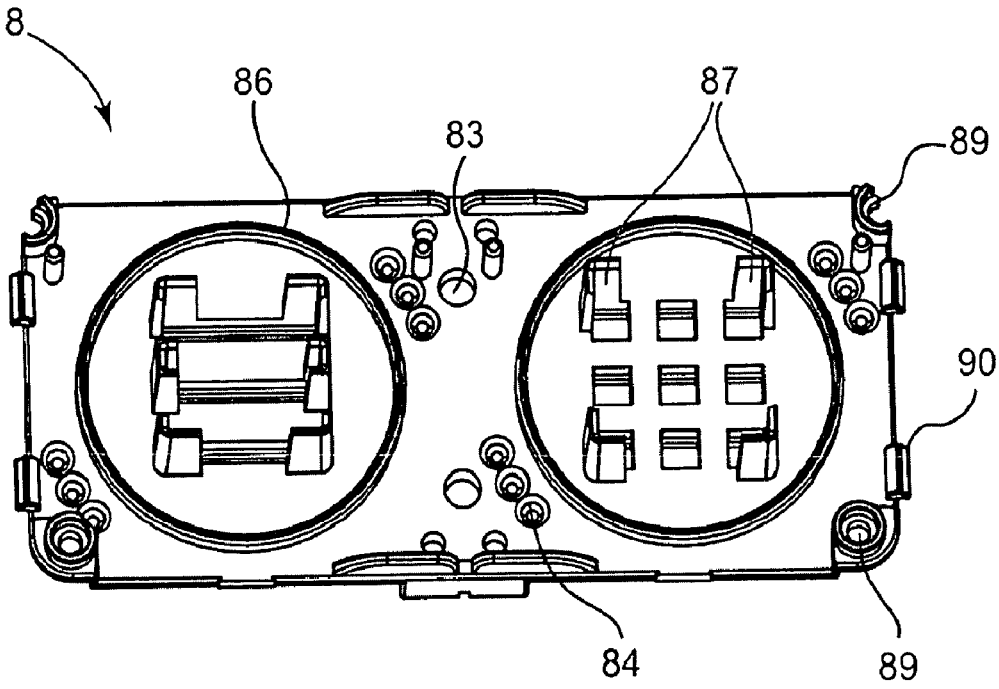
FIG. 12 is a set of perspective views of the top and bottom of the lower die component of the preferred embodiment.
Figure 12:
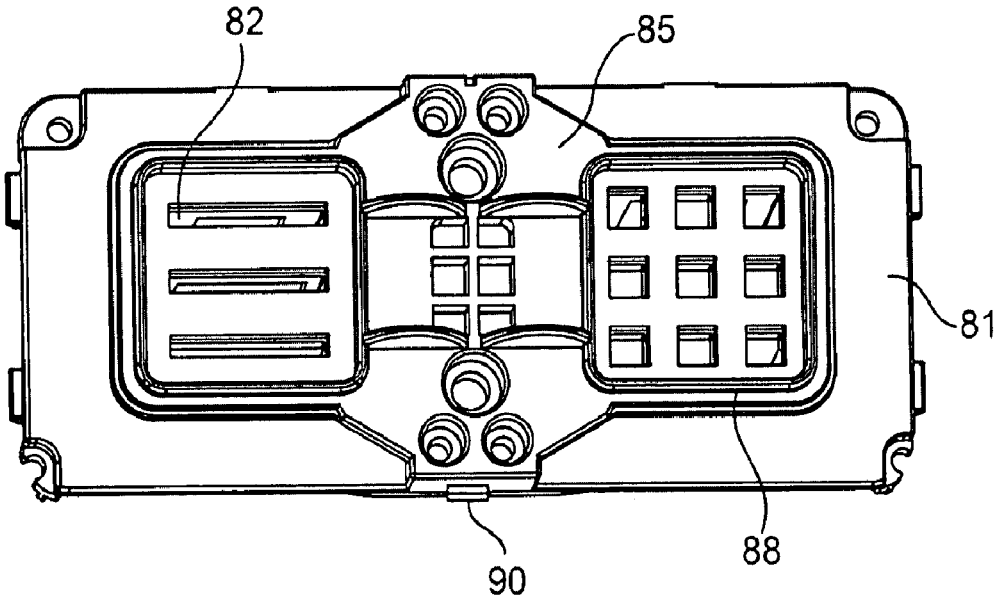

The angular position of the steps around the circumference of base 41 corresponds to the angular separation of the indicia 73 around the circumference of selector 7 (see FIG. 13) and that of depressions 84 on die 8 (see FIG. 12). In the preferred embodiment illustrated, a separation of ten degrees is used, but other values may be used in other embodiments.

The particulars of steps 55, 56, 57 of punch component 5 are preferably analogous to those of like numbered elements of punch component 4.

As mentioned above, and as may be seen by contrasting the three central cutting elements 44 of punch 4 to the single central cutting element 54 of punch 5, the three elements 44 of the former are not at the same height. However, each of them is at a height greater than the highest member of the next-highest group on punch 4. In fact, each of the three elements of each such group lies at a height that varies within its group. A similar observation applies to the curvature of each cutting element of punch 5. Even further variation occurs in the angle relative to the perpendicular direction above the base of the punch at which each individual cutting surface is oriented. Such variations provide improved performance of each cutting surface, and thus are preferred but not required.

As best illustrated in the cross-section portion of FIG. 11, the non-punching side of base 51 of punch 5 may define a recess 58 for snugly receiving the ledge 21 of its respective button 2 (see FIG. 9). Punch 4 has similar features (not illustrated) for ledge 11 of button 1.

Preferred materials for the punches include metals and alloys, such as zinc alloys commonly used in punching and cutting applications (most preferred).

FIG. 12 illustrates the die 8, which defines sets of holes 82. Each set of holes 82 is located directly above one of passages 92 defined in base 9, and each individual hole is directly below a corresponding cutting element of one of punches 4, 5. Die 8 also presents a lower face 81 that defines the upper portion of slot 11 (see FIG. 3). Holes or similar features 89 at each of the four corners of die 8 accept four screws 10 to attach die 8 to holes 38 of cover 3 (see FIG. 7) and thus form a sub-assembly to which base 9 may be attached. For this purpose, holes 83 allow the central pair of screws 10 to pass though die 8 and reach holes 33 in cover 3 as described above. In addition, a series of alignment tabs 90 at various locations around the outer perimeter of die 8 may be used with the complimentary indentations 39 of cover 3 (see FIG. 7) to increase the integrity and alignment of the sub-assembly.

Each elevated housing portion 87 has sufficient height to ensure that each punch 4, 5 is seated within the perimeter of elevated housing portion 87 when unit 100 is not in use as well as during punching at each of the three possible positions. In addition, as mentioned above, each cutting element is aligned with a hole 82, and it is further possible to ensure that the tallest set of cutting elements is initially located within its respective hole 82 but not extending into slot 11 until the first (and subsequent) cutting positions are reached. Each of these helps ensure that each punch 4, 5 has little, if any, lateral play in its movement during punching, which increases the precision of the results.

Other features of die 8 are dictated by the overall construction of unit 100, according to principles known in the art. Preferred materials for the die include metals and alloys, with zinc alloys commonly used in punching and cutting applications for dies being most preferred.

Figure 13:
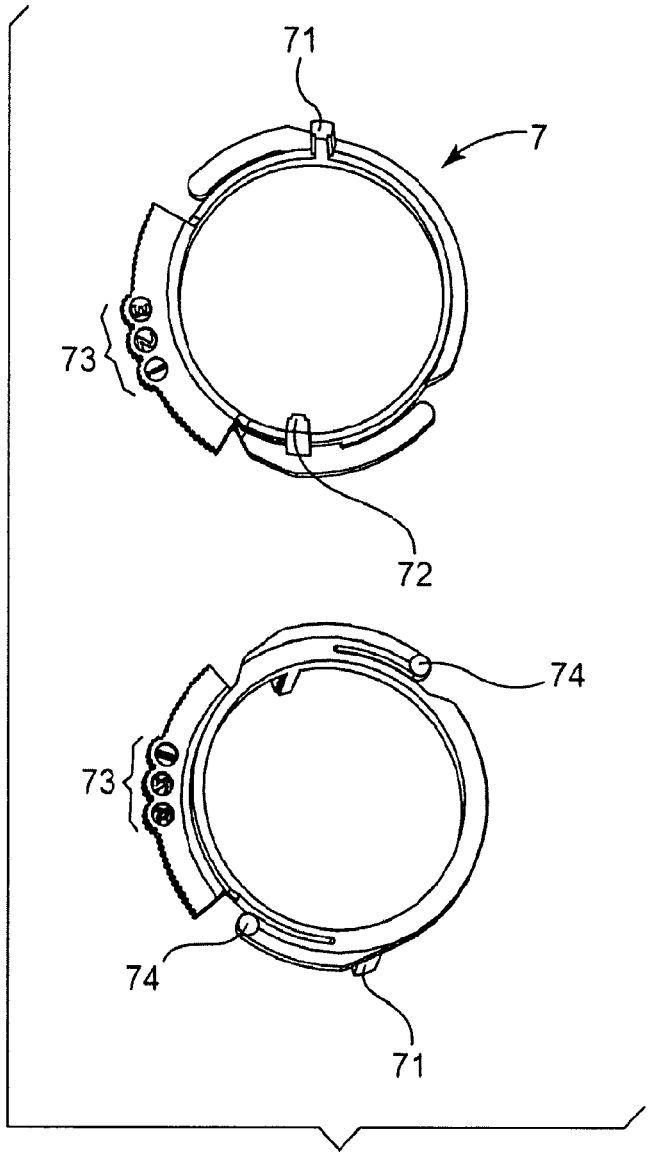
FIG. 13 is a set of perspective views of the top and bottom of one of the selector components of the preferred embodiment.
Figure 14:
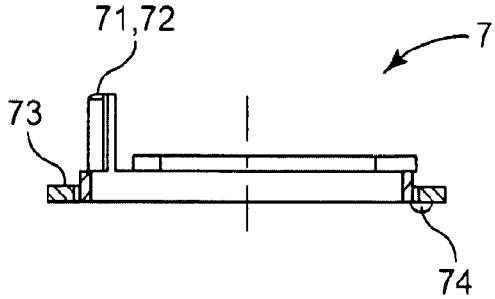
FIG. 14 is a side view of the selector component of FIG. 13.

FIGS. 13 and 14 illustrate a typical selector 7, which is generally shaped like a hollow-centered ring and has a pair of (preferably) diametrically opposed elevated stops 71, 72 extending perpendicularly in the same direction above the plane of the ring. Each such elevated stop 71, 72 contacts a location on the punch 4 or 5 corresponding to the selected pattern, as described above. Indicia 73 extend from slots 34 (see FIG. 6), or are otherwise visible from the outside of unit 100, so that the position of selector 7 (and thus the punched pattern) may be selected. Stops 74 help ensure that the lateral travel of selector 7 is kept within desirable limits. Each stop 74 engages one of the set of three depressions 84 formed in the upper side of die 8 (see FIG. 12). Preferred materials for the selector 7 include polymers and metals, with high performance engineering polymers being preferred; polyoxymethylene (POM) is most preferred.

Returning to FIG. 3, each spring 6 has typically about five turns (effectively three turns), and after compression each spring 6 must return to its normal position so that additional punching may be performed. Number 65 manganese (2.0 mm diameter) spring steel, heat treated and nickel plated, is a suitable material. The diameter and height of the spring is determined by conventional design considerations. Each spring 6 seats within one of the circular features 86 of die 8 and surrounds elevated portions 87 (see also FIG. 12), and thus is compressed by the respective face 42, 52 of punch 4, 5 by movement of the punch downward when button 1, 2 is pressed.

We claim:

1. A unit for producing at least a portion of a coordinated design of cutouts in material, comprising:

at least one spring and spring-loaded punch and die combination, the punch having a plurality of steps;

a button for driving the punch against the spring and into the die to a variable depth; and a punch depth selector comprising a hollow-centered annular ring surrounding the die and at least one stop elevated above the ring;

in which rotation of the annular ring around the die selects the portion of the coordinated design by aligning contact between at least one of the plurality of steps formed in the punch and at least one stop of the punch depth selector, thereby positively stopping the punch from further travel through the die; whereby the punch forms the portion of the coordinated design of cutouts in the material corresponding to the depth selected by the rotation of the annular ring.

2. The unit of claim 1, in which the punch comprises a base and a plurality of groups of discrete cutting elements, each discrete cutting element within a group having a different distance from the base; each group of discrete cutting elements having a different distance from the base; whereby each discrete cutting element forms less than all of each portion of the coordinated design.

3. The unit of claim 1, in which the punch comprises a base and a plurality of cutting elements, each cutting element having a different distance from the base; whereby each cutting element forms a corresponding portion of the coordinated design.

4. The unit of claim 1, in which the coordinated design comprises three groups of cutouts.

5. The unit of claim 1, in which the coordinated design comprises more than one group of three cutouts per group.

6. The unit of claim 1, in which each cutout is a square or rectangle.

7. The unit of claim 1, comprising two independently operable combinations of spring and spring-loaded punch and die, each combination having differing discrete cutting elements such that the unit produces different coordinated designs of cutouts in the material.

8. The unit of claim 1, in which the unit provides three punch depths.

9. The unit of claim 1, in which the unit is contained within a housing and a base which define a slot between themselves such that a workpiece may be inserted into the unit from any of three sides.

10. The unit of claim 1, in which the unit is contained within an interior of a housing which defines a slot through which the annular ring extends outwardly from the interior of the housing.

11. The unit of claim 1, in which a surface of the punch facing away from the die defines a recess into which the button is seated.

12. The unit of claim 1, in which the annular ring rotates around the die in a plane perpendicular to movement of the punch through the die.

13. The unit of claim 1, in which motion of the annular ring to select a punch depth is independent of motion of the button to drive the punch into the die.

* * * * *